US011363871B2

(12) United States Patent
Bridgett

(10) Patent No.: US 11,363,871 B2
(45) Date of Patent: Jun. 21, 2022

(54) HAIR STYLING DEVICE

(71) Applicant: Diversame, Inc., Pittsburgh, PA (US)

(72) Inventor: Tamiah Bridgett, Pittsburgh, PA (US)

(73) Assignee: Diversame, Inc., Pittsburgh, PA (US)

( * ) Notice: Subject to any disclaimer, the term of this patent is extended or adjusted under 35 U.S.C. 154(b) by 640 days.

(21) Appl. No.: 15/708,621

(22) Filed: Sep. 19, 2017

(65) Prior Publication Data

US 2018/0078016 A1 Mar. 22, 2018

Related U.S. Application Data

(60) Provisional application No. 62/396,377, filed on Sep. 19, 2016.

(51) Int. Cl.
*A45D 20/12* (2006.01)

(52) U.S. Cl.
CPC ..... *A45D 20/122* (2013.01); *A45D 20/12* (2013.01)

(58) Field of Classification Search
CPC .... A45D 20/12; A45D 20/122; A45D 20/124; A45D 20/48; A45D 20/50; A45D 20/52; A45D 20/525; B08B 5/02
USPC .... 132/271, 272, 129, 131, 136; 34/96–101; 15/405–409, 418, 419
See application file for complete search history.

(56) References Cited

U.S. PATENT DOCUMENTS

| | | | | |
|---|---|---|---|---|
| 5,060,398 | A | 10/1991 | Wolens | |
| 5,553,632 | A | 9/1996 | Burkhardt | |
| 5,729,907 | A | 3/1998 | Santhouse et al. | |
| 6,009,883 | A | 1/2000 | Morrow | |
| D433,183 | S | 10/2000 | Kwong | |
| 7,152,610 | B2 | 12/2006 | Csavas | |
| 8,209,877 | B2 | 7/2012 | Smal | |
| D670,862 | S | 11/2012 | Petruccelli, Jr. et al. | |
| 8,490,633 | B1 * | 7/2013 | Kennedy | A45D 1/16 132/228 |
| D726,370 | S | 4/2015 | Han | |
| D749,783 | S | 2/2016 | Norwid | |
| 9,578,945 | B2 | 2/2017 | Han | |
| 2003/0052115 | A1 * | 3/2003 | Leung | A45D 20/50 219/222 |
| 2010/0071223 | A1 | 3/2010 | Ha | |
| 2012/0055501 | A1 * | 3/2012 | Seng | A45D 20/04 132/211 |
| 2012/0291797 | A1 | 11/2012 | deGrood et al. | |

(Continued)

FOREIGN PATENT DOCUMENTS

| | | | | |
|---|---|---|---|---|
| EP | 940101 | B1 | 9/1999 | |
| FR | 2980084 | A1 * | 3/2013 | A45D 20/12 |

(Continued)

*Primary Examiner* — Tatiana L Nobrega
*Assistant Examiner* — Sarah Woodhouse
(74) *Attorney, Agent, or Firm* — Fox Rothschild LLP

(57) ABSTRACT

A hair styling device for use with an end styling attachment. The hair styling device comprises a housing, and the housing comprises a motor, a fan, a heating element, and an air concentrator. A styling attachment is configured to be removably attached to an end of the air concentrator and the styling attachment comprises a comb and an air diffuser. The comb of the styling attachment may comprise three paired rows of teeth having differing lengths and shapes, and the styling attachment may further comprise temperature and/or proximity sensors therein.

14 Claims, 10 Drawing Sheets

(56) References Cited

U.S. PATENT DOCUMENTS

| | | | | |
|---|---|---|---|---|
| 2013/0068245 | A1* | 3/2013 | De Benedictis | A45D 2/367<br>132/237 |
| 2013/0074867 | A1 | 3/2013 | Leung | |
| 2015/0216280 | A1* | 8/2015 | Sayers | A45D 1/06<br>132/269 |
| 2015/0230578 | A1* | 8/2015 | Sze | A45D 8/14<br>132/284 |
| 2016/0166042 | A1* | 6/2016 | Albisetti | A61K 8/062<br>132/200 |

FOREIGN PATENT DOCUMENTS

| | | | | |
|---|---|---|---|---|
| FR | 3010284 | B1 * | 3/2017 | A45D 1/04 |
| GB | 2230184 | A * | 10/1990 | A45D 20/50 |
| GB | 2365335 | A | 2/2002 | |
| JP | 2012239535 | A | 12/2012 | |
| WO | 1991008690 | A1 | 6/1991 | |
| WO | WO-2007003795 | A2 * | 1/2007 | A45D 2/002 |
| WO | WO-2017078191 | A1 * | 5/2017 | A45D 20/12 |

* cited by examiner

HAIR STYLING DEVICE

RELATED APPLICATIONS AND CLAIM OF PRIORITY

This patent document claims priority to U.S. Provisional Patent Application No. 62/396,377, filed Sep. 19, 2016, the disclosure of which is fully incorporated into this document by reference.

BACKGROUND

The use of hand-held blow dryers for drying and styling hair is well-known, as is the utilization of various styling attachments to provide additional functionality to the device, such as combs, picks, and diffusers. However, such styling attachments are often difficult to use and are prone to damage and failure, particularly when employed by a person having dense, curly, afro-textured hair. That is, the tines of an attachment comb or pick may bend or break as the user draws the comb or pick through their hair. Unfortunately, those with dense, curly, afro-textured hair are also generally those with the greatest need for such attachments, as their hair is often more difficult to dry and/or naturally style or straighten.

Additionally, while styling attachments such as combs, picks, and diffusers are known, they are generally single-purpose attachments. That is, the user is required to have multiple attachments at their disposal if, for example, they desired to use both a comb and a diffuser. In such an instance, the user would need to attach the comb, detach the comb, and then attach the separate diffuser.

Another disadvantage to known hand-held blow dryers using styling attachments is that the styling attachment predictably causes the user to hold the blow dryer in much closer proximity to their hair than if it were being used without a styling attachment. As high heat often leads to faster and more effective drying, straightening, and/or styling, many users naturally default to using the highest heat setting on the blow dryer. However, utilization of a styling attachment with a high-heat setting may lead to burnt or heat-damaged hair, as the styling attachment requires physical contact with the user's hair.

Accordingly, this document describes devices that are intended to address the issues discussed above and/or other issues.

SUMMARY

In at least one aspect, the document describes a styling attachment for a hair styling device. The styling attachment includes an air diffuser and a comb. The comb includes an outer row of a first set of teeth, wherein each tooth in the first set of teeth has a first wide surface and second wide surface opposite the first wide surface and first and second narrow surfaces disposed between the first and second wide surfaces, and the teeth of the first set of teeth are positioned in a row so that the elongated sides of the teeth in the first set of teeth face outward from the styling attachment. The comb also includes an inner row of a second set of teeth that are each smaller than the teeth of the first set of teeth, as well as a middle row of a third set of teeth positioned between the outer row and the inner row, wherein each tooth in the third set of teeth is smaller than the teeth of the first row and larger than the teeth of the second row, each tooth in the third set of teeth has a first wide surface and a second wide surface, opposite the first wide surface and first and second narrow surfaces disposed between the first and second wide surfaces, and the teeth in the third set of teeth are positioned in a row so that the first narrow sides of the teeth of the middle row of teeth face the outer row.

In another aspect, the document describes a hair styling system including a blow dryer comprising a housing, wherein the housing encloses a motor and a fan, an air concentrator extending from the housing and a heating element disposed in the air concentrator. The hair styling system also includes a styling attachment comprising a body having a proximal end that is removably attached to an end of the air concentrator, and a distal end opposite the proximal end, the body defining a longitudinal axis extending between the proximal and distal ends, wherein the styling attachment includes an air diffuser and a comb. The comb includes an outer row of a first set of teeth, wherein each tooth in the first set of teeth has a first wide surface and a second wide surface opposite the first wide surface, and first and second narrow surfaces disposed between the first and second wide surfaces, and the teeth of the first set of teeth are positioned in a row so that the second wide surface faces outward from the styling attachment. The comb also includes an inner row of a second set of teeth that are each smaller than the teeth of the first set of teeth, and a middle row of a third set of teeth positioned between the outer row and the inner row, wherein each tooth in the third set of teeth is smaller than the teeth of the first row and larger than the teeth of the second row.

According to another aspect, the document describes a hair styling device. The hair styling device includes a housing, wherein the housing includes a motor, a fan, a heating element, an air concentrator, and a controller. The hair styling device further includes a styling attachment that is removably attached to an end of the air concentrator. The styling attachment includes an air diffuser, a comb, and at least one of a temperature sensor and a proximity sensor. The controller is configured to receive signals from at least one of the temperature and proximity sensors and, in response to receiving signals indicating that at least one of (1) the temperature sensor has sensed a temperature that is above a threshold, and (2) the proximity sensor has detected that the styling attachment is within a threshold distance of a human's head, automatically shut off at least one of the heating element and the motor.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

Figure 1:
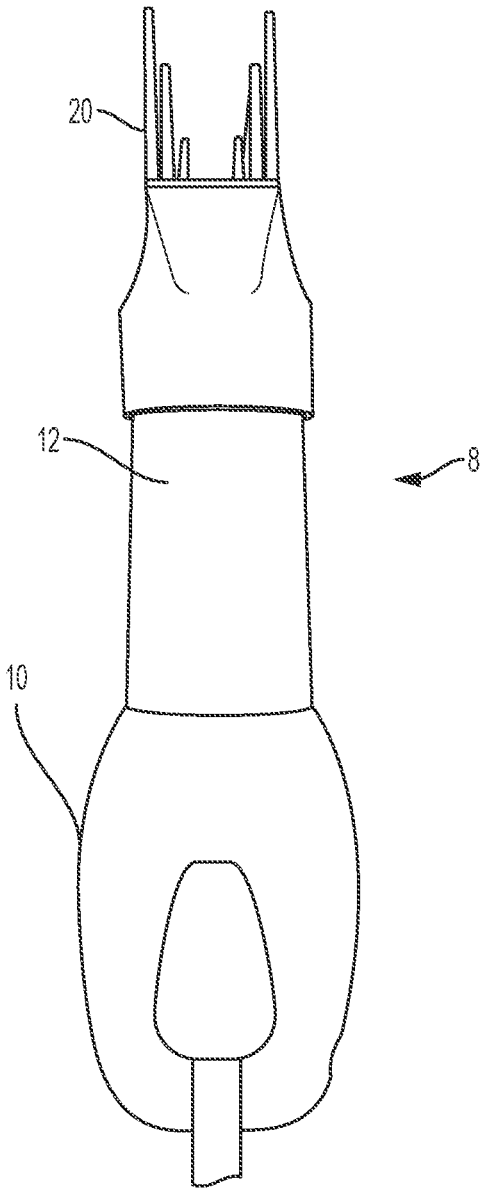
FIG. 1 illustrates a side view of a blow dryer having a styling attachment in accordance with an aspect of the present disclosure.

Referring to FIG. 1, a hair styling device, and in this embodiment a blow dryer 8 in accordance with an example aspect of the present disclosure is shown. Blow dryer 8 is shown as a tubular dryer having a motor/fan housing 10, a concentrator 12, and a styling attachment 20. The blow dryer 8 may be formed of any appropriate material, such as a heat-resistant, injection molded material. Motor/fan housing 10 is sized to house the drive motor and fan of blow dryer 8, as will be further described below. Accordingly, motor/fan housing 10 is slightly larger in diameter than concentrator 12, which is tapered so as to concentrate air flow from a fan to the distal point of use. The tubular-shaped dryer may be held directly in the user's hand, without the need for a separate handle extending therefrom. Such a configuration enables greater control of the blow dryer 8, particularly when used in conjunction with the styling attachment 20. The blow dryer 8 may be, e.g., 11½ inches in length, with a circumference of, e.g., 7 inches at the distal point of use. Other sizes are possible in various embodiments.

Figure 2:
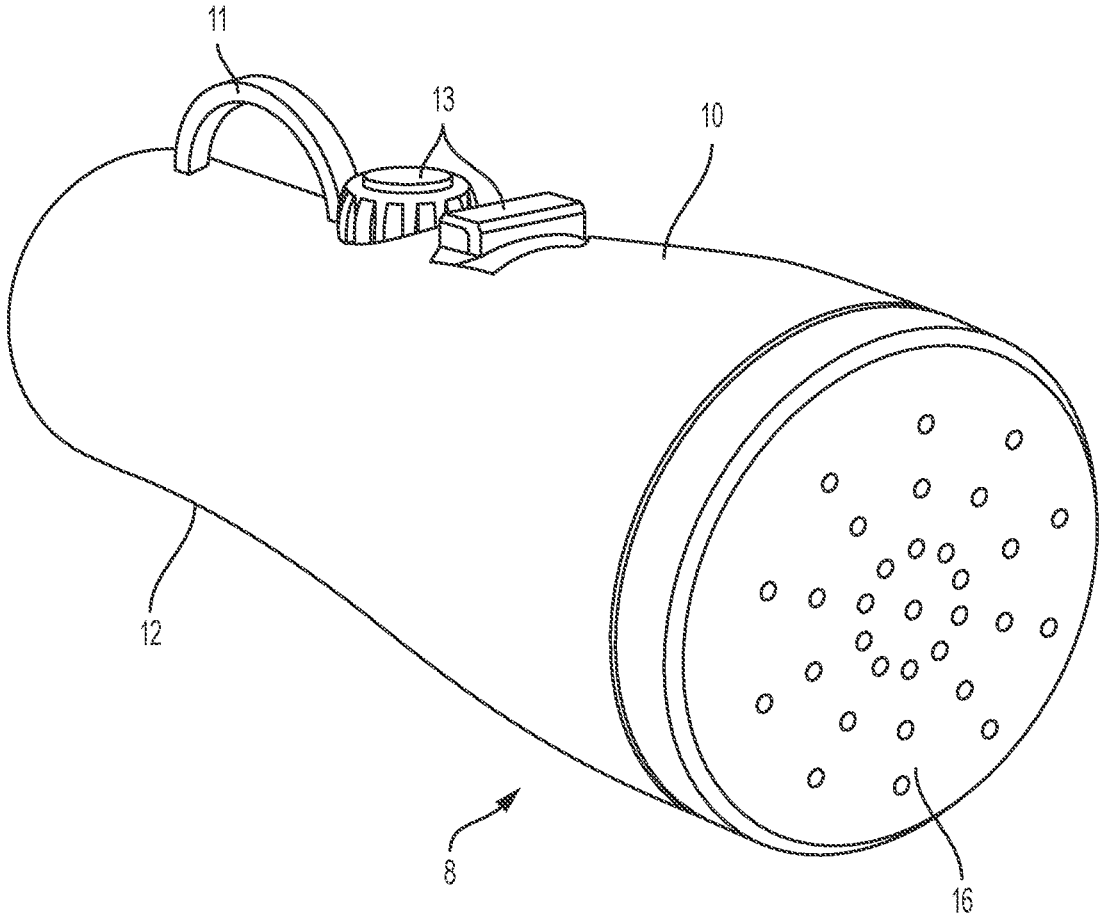
FIG. 2 illustrates a rear perspective view of a blow dryer in accordance with an aspect of the present disclosure.

FIG. 2 illustrates further details of blow dryer 8. Blow dryer 8 may comprise a hand grip 11 fastened along a length of the concentrator 12 so as to reduce operator fatigue while using the blow dryer 8. Hand grip 11 may be, e.g., ½ inch in width and 6 inches in length, but may alternatively be any suitable length and may, in fact, be adjustable by the user. Additionally (or alternatively), the blow dryer 8 may have a coating (e.g., a silicone coating) thereon to improve the user's grip and comfort, and may further have defined finger grip regions within the coating. The motor may be powered by a standard cord and plug, or may alternatively be powered cordlessly (i.e., via a rechargeable or replaceable battery). While not shown, the cord and plug may be configured to be retractable within the blow dryer 8 so as to reduce the device's footprint when not in use.

Blow dryer 8 further comprises a power/temperature/speed control interface 13, which enables the user to power on/off the blow dryer 8 and manually control the speed of airflow and/or temperature of the airflow. For example, temperature settings may be "Cool", "Low Heat", "Medium Heat", and "High Heat", wherein the blow dryer is configured to operate at temperatures between ambient and 320° F. Meanwhile, speed settings may be "Low", "Medium", and "High", with fan speeds between 25-40 miles per hour. However, it is to be understood that more or fewer speed and temperature settings are also possible. The power/temperature/speed control interface 13 may include any one or more appropriate device(s) for incremental or infinite adjustment, such as a variable knob, a digital interface having adjustment arrows, a toggle switch, etc. Furthermore, the power/temperature/speed control interface 13 may be located at any location upon blow dryer 8.

Figure 3:
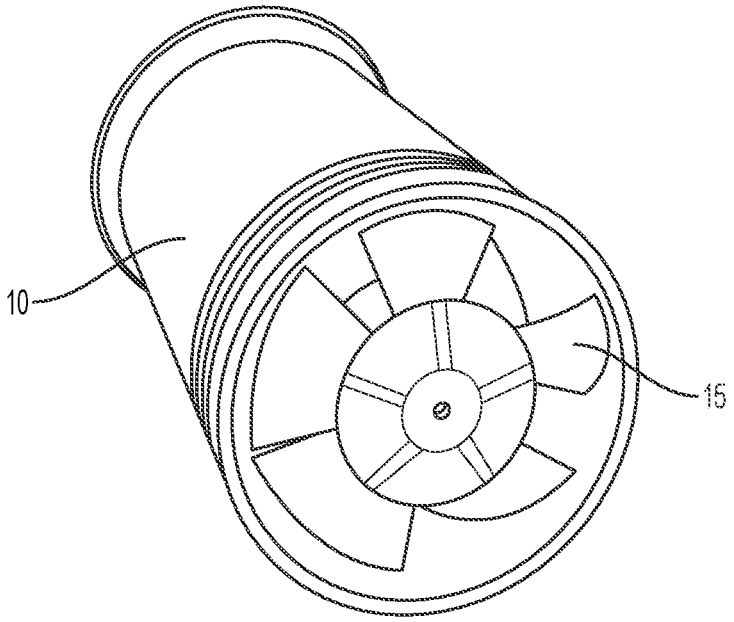
FIG. 3 illustrates a cut-away front perspective view of the blow dryer of FIG. 1 and FIG. 2.
Figure 4:
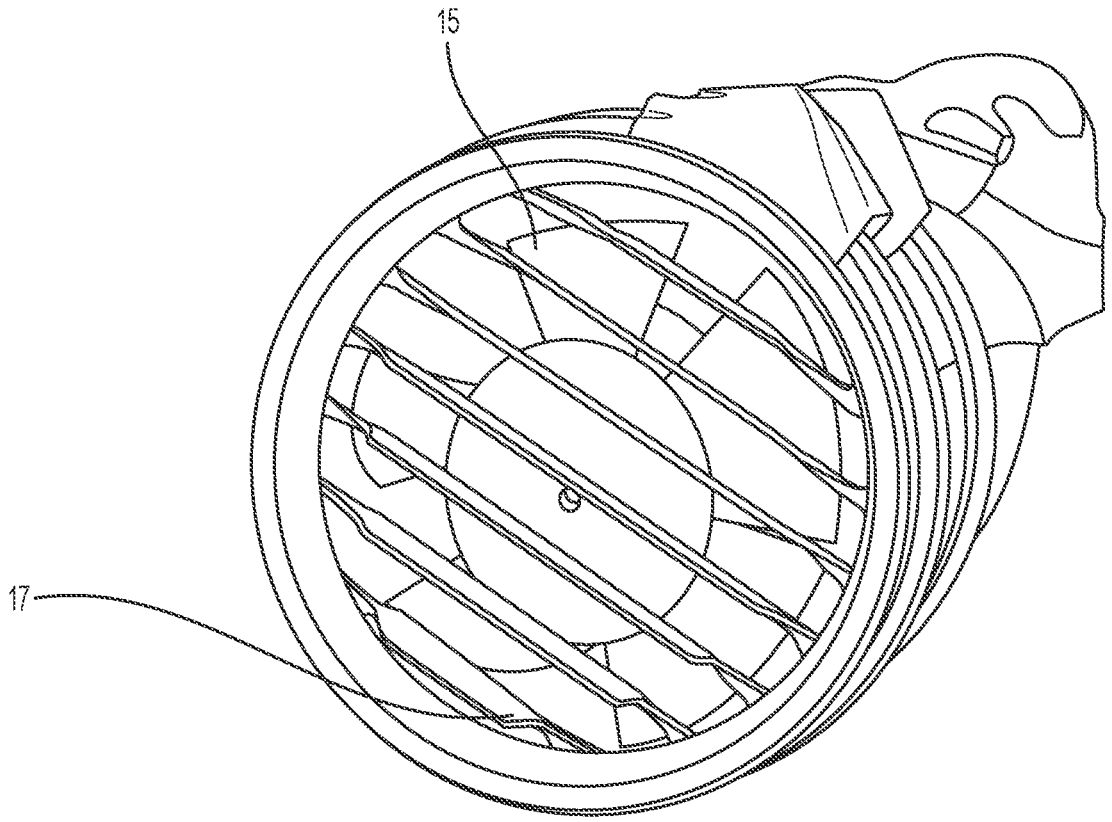
FIG. 4 illustrates a front perspective view of the blow dryer of FIG. 1 and FIG. 2.

At a proximal end of blow dryer 8 is a filter 16, which may be any suitable air filter for drawing air into to the motor/fan housing 10 while simultaneously preventing entry of outside objects (such as the user's hair) therethrough. As shown in FIG. 3, a fan 15 is disposed within the motor/fan housing 10. The fan 15, when rotated by the motor (not shown), propels air through the concentrator 12 toward the distal end of use at varying speeds selected by the user. Referring to FIG. 4, a heating element 17 is disposed adjacent to fan 15. Heating element 17 may be any heating device, such as a heating coil/ceramic/tourmaline configuration. As air is drawn through filter 16, it crosses heating element 17 to become heated, and is then propelled by fan 15 through concentrator 12. As described above, the user is able to control the heat settings of heating element 17 such varying temperatures may be chosen dependent upon the application.

Figure 5:
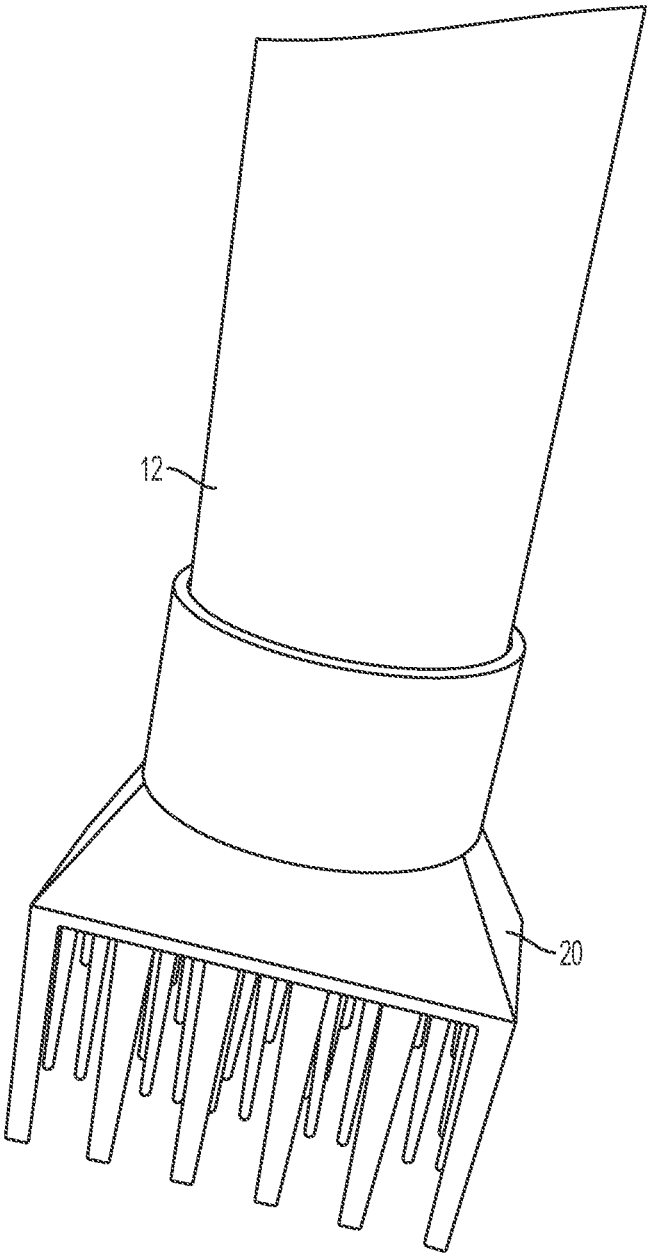
FIG. 5 illustrates a perspective view of a blow dryer and styling attachment in accordance with an aspect of the present disclosure.
Figure 6A:
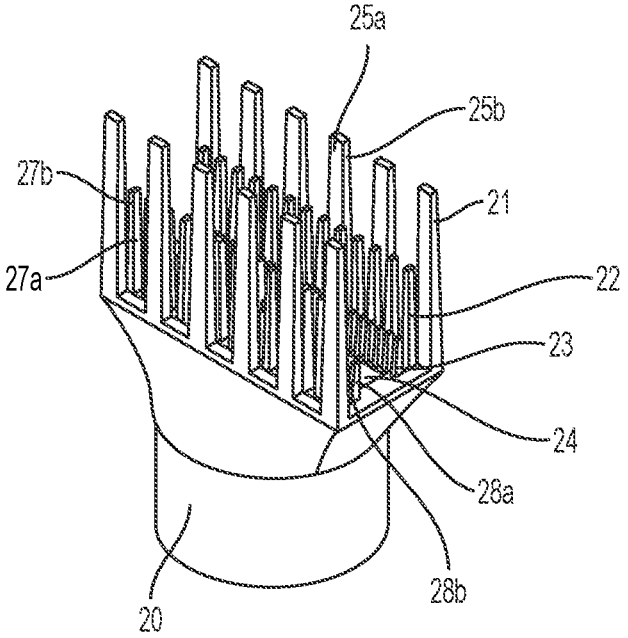
FIG. 6A illustrates a perspective view of a styling attachment in accordance with an aspect of the present disclosure.
Figure 6B:
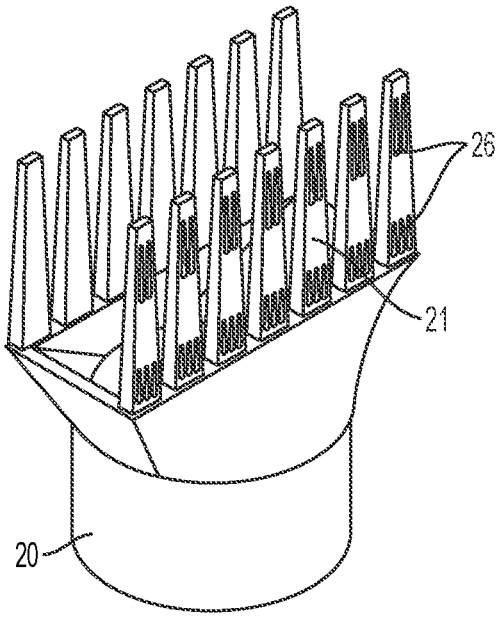
FIG. 6B illustrates a perspective view of a styling attachment in accordance with another aspect of the present disclosure.

Referring now to FIG. 5, FIG. 6A, and FIG. 6B, a styling attachment 20 in accordance with an aspect of the present disclosure is illustrated. Styling attachment 20 is configured to be securely (but removably) attached to the distal tapered end of concentrator 12. For instance, styling attachment 20 may be secured via a clamp to the concentrator 12, via corresponding magnets on the styling attachment 20 and concentrator 12, or via suction generated by the fan and motor. It is to be understood that other, alternative means of coupling styling attachment 20 to concentrator 12 are also contemplated, such as a threaded or screw-on configuration between styling attachment 20 and concentrator 12, or a simple press-fit configuration.

In the example illustrated in FIG. 6A, styling attachment 20 comprises six total rows of teeth, with three paired rows each containing sets of teeth having different lengths and/or shapes. Specifically, outer teeth 21 are the longest of the three rows, with each tooth 21 having a length of, e.g., 1¾ inches. Each outer tooth 21 has respective wide surfaces 25*a* and narrow surfaces 25*b*, thereby forming a relatively flat and thick tooth. As shown in FIG. 6A, the wide surfaces 25*a* are preferably positioned so as to face laterally outward relative to styling attachment 20, thereby allowing each tooth 21 to slightly flex laterally outward (or inward). Although these examples show six total rows, versions with just one side of three rows, or versions with more than three rows on each side, are possible.

A pair of rows of middle teeth 22 are disposed adjacent to outer teeth 21, with middle teeth 22 being shorter (e.g., 1¼ inches), thinner, and more pointed at the distal tip than outer teeth 21. Furthermore, each middle tooth 22 has respective wide surfaces 27*a* and narrow surfaces sides 27*b*, with narrow surfaces 27*b* facing the adjacent wide surfaces 25*a* of outer teeth 21. Thus, middle teeth 22 are positioned perpendicularly relative to the adjacent outer teeth 21. With such a configuration, middle teeth 22 may resist flexing laterally outward (or inward), opposite of the flexing direction of outer teeth 21. Accordingly, middle teeth 22 may act as a support for outer teeth 21, limiting the total amount of lateral flex of outer teeth 21, as middle teeth 22 will resist such lateral flex as the respective teeth are run through the user's hair.

Next, a pair of rows of inner teeth 23 are disposed adjacent to middle teeth 22 such that middle teeth 22 extend between respective rows of inner teeth 23 and outer teeth 21. Inner teeth 23 are more densely spaced and shorter (e.g., ¾ inch) than both middle teeth 22 and outer teeth 21. Inner teeth 23 each comprise an wide surfaces 28*a* and narrow surfaces 28*b*. In the example shown in FIG. 6A, the narrow surfaces 28*b* of inner teeth 23 are also positioned perpendicularly relative to outer teeth 21, and thus also resist flexing laterally outward (or inward). In this way, inner teeth 23 also provide added support to adjacent middle teeth 22 and outer teeth 21. Between rows of inner teeth 23 lies a concentrator opening 24, which allows air from the blow dryer to flow therethrough such that styling attachment 20 provides both a combing function and a drying function. While not shown, it is also contemplated that a latch can be added to an outer portion of the styling attachment 20 so as to retain a separate diffuser over the concentrator opening 24, thereby diffusing the air expelled through styling attachment 20.

Referring to FIG. 6B, another aspect of styling attachment 20 in accordance with the present disclosure is illustrated. Outer teeth 21 are formed so as to have a hollow cavity therein, and each comprise a plurality of air holes (or ports) 26 on a wide surface thereof. The hollow cavity of outer teeth 21 and the air holes 26 are in fluid communication with the blown air passing through styling attachment 20 so as to diffuse the air, allowing the teeth 21 to act both as a comb and a diffuser. While shown facing outwardly on outer teeth 21, it is to be understood that air holes 26 could instead face inwardly, or air holes 26 could be located on both outward and inward facing surfaces of outer teeth 21. Furthermore, while a plurality of air holes 26 are shown in FIG. 6B, it is further contemplated that each outer tooth 21 could have a single air hole 26 therein.

Figure 7:
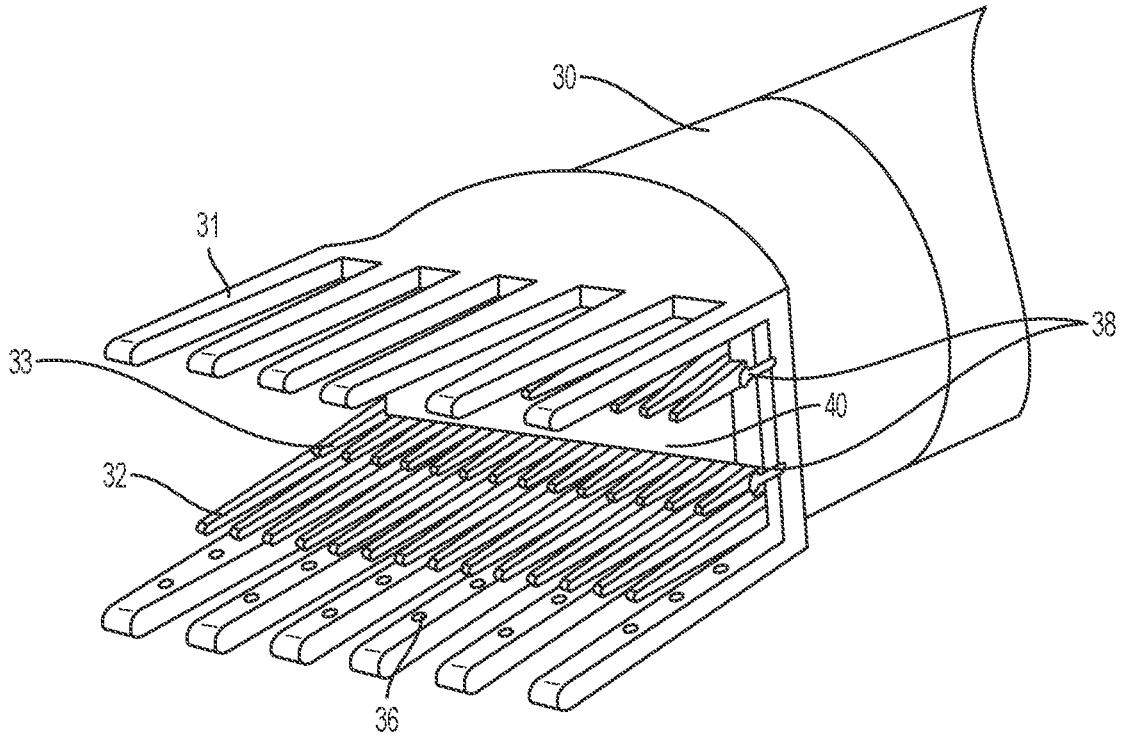
FIG. 7 illustrates a perspective view of a blow dryer and styling attachment in accordance with another aspect of the present disclosure.
Figure 8:
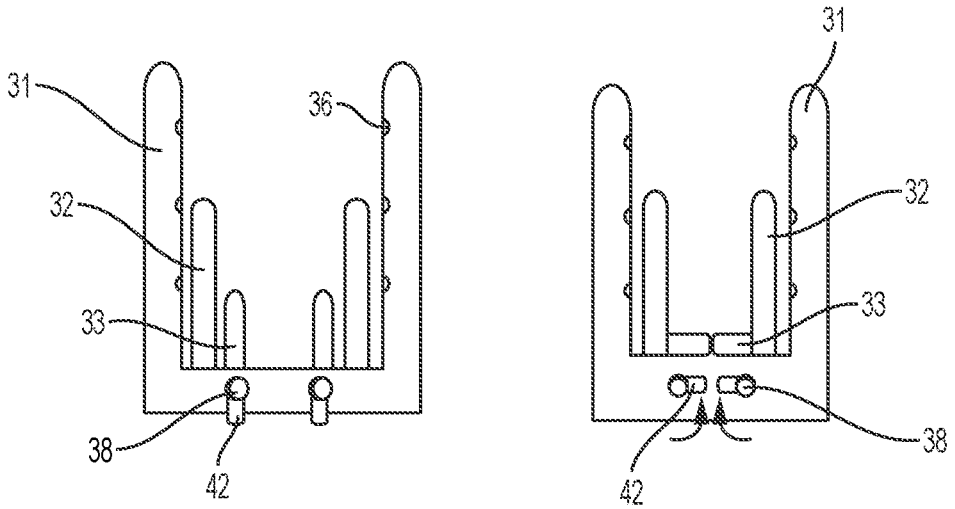
FIG. 8 illustrates a side profile view of portions of the styling attachment of FIG. 7.
Figure 9:
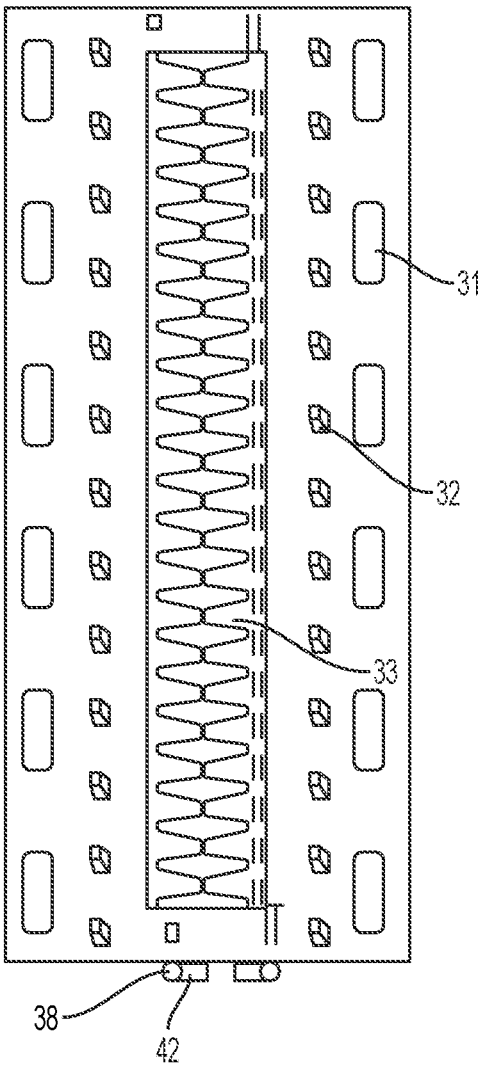
FIG. 9 illustrates a top view of portions of the styling attachment of FIG. 7.

Next, referring to FIGS. 7-9, a styling attachment 30 in accordance with an alternative aspect of the present disclosure is shown. Similar to styling attachment 20 described above, styling attachment 30 comprises six total rows of teeth, with three paired rows each containing sets of teeth having different lengths and/or shapes. Outer teeth 31 are the longest of the teeth, followed by middle teeth 32, and finally inner teeth 33, which are the shortest and most closely spaced of the teeth. While middle teeth 32 and inner teeth 33 are ideally formed have a solid core, outer teeth 31 are preferably formed with a hollow cavity therein and to be in fluid communication with the blow dryer. Outer teeth 31 further comprise a plurality of air holes 36 formed therein so as to allow blown air from the blow dryer to pass therethrough, which diffuses the blown air.

Inner teeth 33 are disposed adjacent to a concentrator opening 40, similar to inner teeth 23 discussed above. However, unlike inner teeth 23, inner teeth 33 are configured to be pivotable inwardly in the direction of concentrator opening 40 via respective adjustment pins 38. As shown in FIG. 8, adjustment pins 38 are coupled to a lever 42 or similar device. In a first configuration (i.e., an "open" configuration), adjustment pins 38 hold inner teeth 33 in an upwardly extending position. However, when lever 42 is rotated to a second configuration (i.e., a "closed" configuration), inner teeth 33 are capable of rotating inwardly about adjustment pins 38 so as to substantially cover concentrator opening 40. FIG. 9 further illustrates the "closed" configuration. With inner teeth 23 rotated to the "closed" configuration, the air blown through styling attachment 30 is further diffused, as inner teeth 23 substantially block the free flow of air through concentrator opening 40. Accordingly, styling attachment 30 may act as a combined comb and diffuser, without the need for changing attachments or overlaying separate diffuser components over concentrator opening 40.

While the embodiment discussed with respect to FIGS. 7-9 utilizes the rotated inner row of teeth 33 to act as part of a diffuser, other configurations are also contemplated. For instance, the styling attachment may be rotatable about the concentrator such that relative rotation may open or close air channels exiting the diffuser, similar to a rotatable shower head. Thus, in a first, open configuration, the styling attachment may allow air to flow freely therethrough. Rotation of the styling attachment may place the styling attachment in a second, closed configuration, wherein air is diffused as it flows out of the styling attachment.

Figure 10:
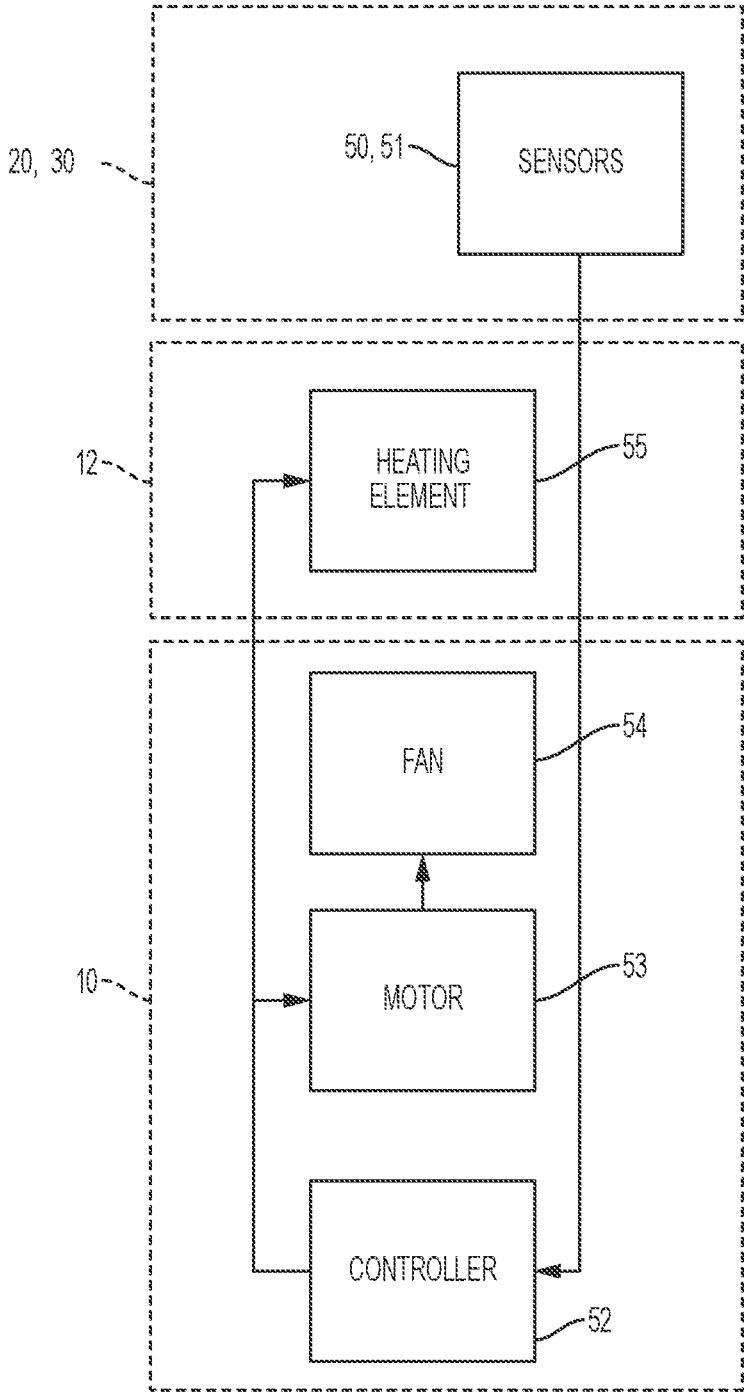
FIG. 10 illustrates a schematic view of a blower dryer and styling attachment in accordance with another aspect of the present disclosure.

Referring now to FIG. 10, a schematic representation of a blow dryer assembly in accordance with another aspect of the disclosure is shown. FIG. 10 schematically illustrates a motor/fan housing 10, a concentrator 12, and a styling attachment 20, 30 similar to those discussed in FIGS. 5-9 above. Within motor/fan housing 10 is a motor 53 and fan 54. Concentrator 12 contains a heating element 55, though it is to be understood that heating element 55 may alternatively be located within motor/fan housing 10. Also contained within motor/fan housing 10 is a controller 52, which is in communication with motor 53 and heating element 55. Controller 52 may be operable to control both motor 53 and heating element 55 based upon user-desired settings chosen on a user interface, such as fan speed and heat settings.

While not shown in the schematic illustration of styling attachment 20, 30, in FIG. 10, it is to be understood that styling attachment 20, 30, is similar to that shown and described with respect to FIGS. 5-9, and thus includes multiple rows of teeth having different lengths and cross-sectional shapes. Styling attachment 20, 30, shown in FIG. 10 further includes sensors 50, 51 in communication with controller 52. Sensor 50 may be, for example, a temperature sensor, while sensor 51 may be, for example, a proximity sensor such as an ultrasonic, capacitive, photoelectric, inductive, or magnetic proximity sensor. As discussed previously, the high-heat setting of the blow dryer may cause damage to hair if the hair itself is brought into close contact with heated air. As the user's hair is often in close proximity to the heated air due to the use of styling attachment 20, 30, the risk of damage is increased. However, sensors 50, 51 may be employed to prevent such damage if certain conditions are met. For example, if controller 52 determines, via the signal received from temperature sensor 50, that the temperature of the air being expelled from the blow dryer is higher than a predetermined threshold for suitable use with the styling attachment 20, 30 (e.g., at or above 300° F.), controller 52 may shut down motor 53, the heating element 55, or both. Similarly, if controller 52 determines, via the signal received from proximity sensor 51, that the styling attachment 20 is being held too close to the user's hair or head for a given threshold temperature, controller 52 may shut down motor 53, the heating element, or both. In this way, the blow dryer may be configured to protect the user's hair (and/or head) from damage due to overheating.

While two sensors 50, 51 are shown in FIG. 10, it is to understood that fewer or more sensors may be employed. For example, only a temperature sensor 50 or only a proximity sensor 51 may be used, or an additional sensor or sensors may be used. The sensors 50, 51 may communicate with the controller 52 through any appropriate means, either wired or wirelessly. Furthermore, sensors 50, 51 may be located at a location on the blow dryer other than the styling attachment 20, such as on a distal end of concentrator 12.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A styling attachment for a hair drying device, comprising:

a body having a proximal end configured to attach to an outlet of a hair drying device and a distal end opposite the proximal end, the body defining a longitudinal axis extending between the proximal and distal end, wherein the distal end comprises a single concentrator opening enclosed by a rectangular wall having opposing first and second short sides and opposing first and second long sides, the rectangular wall extending along a plane perpendicular to the longitudinal axis, wherein a comb comprising six rows of teeth extends along the first and second long sides of the wall, each tooth of the six rows of teeth has a proximal end coupled to the wall and a distal free end, wherein a length of each tooth is defined between the proximal end and the distal free end thereof;

wherein the six rows of the comb comprise: a first and second outer row of teeth, a first and second inner row of teeth, and a first and second middle row of teeth, wherein the first outer, middle, and inner rows are disposed on the first long side and the second outer, middle, and inner rows are disposed on the second long side such that the single concentrator opening is disposed between and separates the first outer, inner and middle row from the second outer, inner and middle row, each tooth of the first and second outer rows of teeth has a first wide surface facing the single concentrator opening, a second wide surface opposite the first wide surface and a first and second narrow side surfaces disposed between the first and second wide surfaces, wherein a width of the first and second wide surfaces is greater than a width of the first and second narrow surfaces at a given position along the length of each comb tooth, and the first and second inner rows of teeth are positioned directly adjacent the concentrator opening and each tooth of the first and second inner rows of teeth has a first narrow surface facing the single concentrator opening, a second narrow surface opposite the first narrow surface and first and second wide surfaces disposed between the first and second narrow surfaces, wherein a width of the first and second wide surfaces is greater than a width of the first and second narrow surfaces at a given position along the length of each comb tooth, and wherein the length of each tooth of the first and second inner rows of teeth is smaller than the length of each tooth of the first and second outer rows of teeth, and each tooth of the first and second middle rows of teeth has a first narrow surface facing the first and second outer rows of teeth, respectively, a second narrow surface opposite the first narrow surface and first and second wide surfaces disposed between the first and second narrow surfaces, and wherein the length of each tooth in the first and second middle row of teeth is smaller than the teeth of the first and second outer row and larger than the teeth of the first and second inner row; and the first and second inner rows of comb teeth are pivotable between an open configuration and a closed configuration, wherein in the open configuration the teeth of the first and second inner row extend substantially parallel to the longitudinal axis and the concentrator opening is unobstructed, and in the closed configuration, the teeth of the first and second inner row are pivoted about an adjustment pin such that distal ends of the teeth in the first inner row abut distal ends of the teeth in the second inner row and the first narrow surfaces of each tooth of the first and second inner rows are disposed over the single concentrator opening for blocking free flow of air and diffusing air exiting the single concentrator opening.

2. The styling attachment of claim 1, wherein the adjustment pin is pivoted by rotation of a lever.

3. The styling attachment of claim 1, wherein the first and second outer rows of teeth comprise of hollow teeth, each of the hollow teeth includes an interior chamber that is capable of being fluidly connected to an air passageway in an air concentrator of a hair drying device when the styling attachment is coupled to the air concentrator of the hair drying device, and each of which includes one or more ports through which air may be expelled.

4. The styling attachment of claim 3, wherein the one or more ports on the outer row of teeth are disposed on the second wide surface such that the one or more ports face outwardly.

5. The styling attachment of claim 3, wherein the one or more ports are disposed on the first wide surface such that the one or more ports face inwardly.

6. The styling attachment of claim 3, wherein the one or more ports are disposed on both the first and second wide surfaces of each tooth in the outer row of teeth, and face both outwardly and inwardly.

7. The styling attachment of claim 1, wherein the styling attachment comprises at least one of a temperature sensor and a proximity sensor.

8. A hair styling system, comprising:

a blow dryer comprising: a housing enclosing a motor and a fan, an air concentrator extending from the housing and a heating element disposed in the air concentrator; and a styling attachment comprising:

a body having a proximal end that is removably attached to an end of the air concentrator, and a distal end opposite the proximal end, the body defining a longitudinal axis extending between the proximal and distal end, wherein the distal end comprises a single concentrator opening enclosed by a rectangular wall having opposing first and second short sides and opposing first and second long sides, the rectangular wall extending along a plane perpendicular to the longitudinal axis, wherein a comb comprising six rows of teeth extends along the first and second long sides of the wall, each tooth of the six rows of teeth has a proximal end coupled to the wall and a distal free end, wherein a length of each tooth is defined between the proximal end and the distal free end thereof;

wherein the six rows of the comb comprise:

a first and second outer row of teeth, a first and second inner row of teeth, and a first and second middle row of teeth, wherein the first outer, middle, and inner rows are disposed on the first long side and the second outer, middle, and inner rows are disposed on the second long side such that the single concentrator opening is disposed between and separates the first outer, inner and middle row from the second outer, inner and middle row, each tooth in the first and second outer rows of teeth has a first wide surface facing the single concentrator opening, a second wide surface opposite the first wide surface and first and second narrow surfaces disposed between the first and second wide surfaces, wherein a width of the first and second wide surfaces is greater than a width of the first and second narrow surfaces at a given position along the length of each comb tooth, and the first and second inner rows of teeth are positioned directly adjacent the concentrator opening and each tooth of the first and second inner rows of teeth has a first narrow surface facing the single concentrator opening, a second narrow surface opposite the first narrow surface and first and second wide surfaces disposed between the first and narrow surfaces, wherein a width of the first and second wide surfaces is greater than a width of the first and second narrow surfaces at a given position along the length of each comb tooth, and wherein the length of each tooth of the first and second inner rows of teeth is smaller than the length of each tooth of the first and second outer rows of teeth, and each tooth of the first and second middle rows of teeth has a first narrow surface facing the first and second outer rows of teeth, respectively, a second narrow surface opposite the first narrow surface and first and second wide surfaces disposed between the first and second narrow surfaces, and each tooth in the first and second middle row of teeth and wherein the length of each tooth in the first and second middle row of teeth is smaller than the length of each tooth of the first and second outer row and larger than the length teeth of the first and second inner row; and the first and second inner rows of comb teeth are pivotable between an open configuration and a closed configuration, wherein in the open configuration the teeth of the first and second inner row extend substantially parallel to the longitudinal axis and the concentrator opening is unobstructed, and in the closed configuration, the teeth of the first and second inner row are pivoted about an adjustment pin such that distal ends of the teeth in the first inner row abut distal ends of the teeth in the second inner row and the first narrow surfaces of each tooth of the first and second inner rows are disposed over the concentrator opening for blocking free flow of air and diffusing air exiting the single concentrator opening.

9. The hair styling device of claim 8, wherein the adjustment pin is pivotable inwardly by rotation of a lever.

10. The hair styling device of claim 8, wherein the first and second outer rows of teeth comprise hollow teeth, each of the hollow teeth includes an interior chamber that is fluidly connected to an air passageway in the air concentrator, and each of which includes one or more ports through which air may be expelled and diffused when the motor and the fan are operating.

11. The hair styling device of claim 8, wherein the styling attachment comprises at least one of a temperature sensor and a proximity sensor, and further wherein the housing comprises a controller.

12. The hair styling device of claim 11, wherein the controller is configured to receive signals from the temperature sensor and, in response to the received signal indicating that the temperature sensor has sensed a temperature that is above a threshold, automatically shut off at least one of the heating element and the motor.

13. The hair styling device of claim 11, wherein the controller is configured to receive signals from the proximity sensor and, in response to the received signal indicating that the proximity sensor has detected that the styling attachment is within a threshold distance of a human's head, automatically shut off at least one of the heating element and the motor.

14. The hair styling device of claim 11, wherein the controller is configured to receive signals from both the temperature and proximity sensors and, in response to receiving signals indicating that (1) the temperature sensor has sensed a temperature that is above a threshold, and (2) the proximity sensor has detected that the styling attachment is within a threshold distance of a human's head, automatically shut off at least one of the heating element and the motor.

* * * * *